United States Patent [19]

Takasaki

[11] Patent Number: 4,704,882

[45] Date of Patent: Nov. 10, 1987

[54] DOOR HANDLE LATCH AND LOCK MECHANISM

[75] Inventor: Kunihiko Takasaki, Chiba, Japan

[73] Assignee: Takigen Seizou Co. Ltd., Tokyo, Japan

[21] Appl. No.: 861,636

[22] Filed: May 7, 1986

Related U.S. Application Data

[63] Continuation of Ser. No. 615,947, May 31, 1984, abandoned.

[30] Foreign Application Priority Data

Nov. 5, 1983 [JP] Japan ..... 58-171746[U]

[51] Int. Cl.[4] ..... E05C 1/12

[52] U.S. Cl. ..... 70/215; 232/DIG. 71; 232/173

[58] Field of Search ..... 70/207, 209, 210, 215, 70/216, 224, 208, 218, 221; 292/DIG. 71, 173, 153

[56] References Cited

U.S. PATENT DOCUMENTS

| | | | |
|---|---|---|---|
| 3,044,815 | 7/1962 | Soss | 292/173 |
| 3,045,465 | 7/1962 | Larson | 292/DIG. 71 |
| 3,081,617 | 3/1963 | McKay | 292/173 |
| 3,209,564 | 10/1965 | Pelcin | 292/173 |
| 3,871,198 | 3/1975 | Miller | 292/173 |
| 4,280,725 | 7/1981 | Berkowitz et al. | 292/DIG. 71 |
| 4,508,377 | 4/1985 | Takasaki | 292/DIG. 71 |

FOREIGN PATENT DOCUMENTS

| | | | |
|---|---|---|---|
| 1032289 | 6/1953 | France | 292/DIG. 71 |

*Primary Examiner*—Gary L. Smith
*Assistant Examiner*—Vinh Luong
*Attorney, Agent, or Firm*—Martin Smolowitz

[57] ABSTRACT

A door handle device and latch mechanism including a device body installed on a door panel. The device body is provided with a handle grip connected thereto by a first pivot pin and has an actuating lever connected to the device body through the first pivot pin, which is mounted unitarily with the handle grip through a second pivot pin. A reset lever is pivotally secured to the handle grip through the second pivot pin acting on the handle grip. A retractable latch mounted in the device body has a lock lever connected thereto by a third pivot pin to check the rearward slide of the latch by engagement with a receiving portion in a bottom plate of the handle device. A reset spring in the handle grip holds the reset lever and a rotatable lock cam in engagement, and also holds the reset leer and the lock lever in engagement. A leaf spring retained in the device body bottom plate releases engagement of the lock lever and bottom plate receiving portion. A lock mounted on the handle grip has a cam lock in engagement with the reset lever secured to a rotor, so that when the rotor is turned the reset lever as depressed by the lock cam turns to release the restraint on the lock lever. The lock lever urged upwardly by the leaf spring turns to release its engagement with the receiving portion of the bottom plate, and permits the latch to be retracted.

4 Claims, 6 Drawing Figures

DOOR HANDLE LATCH AND LOCK MECHANISM

This application is a continuation of application Ser. No. 615,947, filed May 31, 1984, now abandoned.

BACKGROUND OF THE INVENTION

The present invention relates to a door handle device including a latch and lock mechanism for a refrigerator or the like which is locked when not used, and can be unlocked by a push rod located inside a door.

With the prior art handle device for doors shown in U.S. Pat. No. 4,372,591, when a handle grip pivotally mounted on a device body is drawn and rotated, a latch interlocked with the handle grip is slid and retracted into the device body against the urging of a spring. As a result, a front end part of the latch comes away from a seat disposed on the side of a refrigerator body, and the door becomes openable.

When the door is locked, a projection of a lock cam secured to a rotor abuts on a step surface of the latch. Therefore, even when the handle grip is intended to be drawn and rotated, sliding of the latch to recede into the device body is hindered, and the door cannot be opened.

When it is intended to unreasonably open the door in the locked state, pressure is exerted from the step surface of the latch on the lock cam. Nevertheless, any member for supporting the force is not disposed on the side opposite to the side on which the lock cam is subjected to the force. Therefore, the force exerted on the lock cam acts as a bending moment and a shearing moment on the rotor and pin tumblers form a factor for causing distortion damages in them.

SUMMARY OF THE INVENTION

It is accordingly an object of the present invention to provide a handle device for doors which can properly prevent the distortion damages of a rotor and pin tumblers ascribable to a pressure applied to a lock cam.

In one aspect of performance of the present invention, a handle device for a door comprises a device proper or body which is installed on a door panel, a handle grip which is connected to said device body by a first pivot pin, a latch which is retractably mounted on said device body, an actuating lever which is connected in said device body by said first pivot pin and which is mounted unitarily with said handle grip by a second pivot pin, a reset lever which is pivotally secured to said handle grip by said second pivot pin, a lock lever which is connected to said latch by a third pivot pin and which checks receding slide of said latch in engagement with a receiving portion provided in a bottom plate of said device body, a reset spring which is retained in said handle grip and which holds said reset lever and a lock cam in engagement and also holds said reset lever and said lock lever in engagement, a leaf spring which is retained in said device body and which releases the engagement between said lock lever and said receiving portion, and a lock which is mounted on said handle grip and which has said lock cam in engagement with said reset lever secured to a rotor, so that when said rotor of said lock is turned, said reset lever depressed by said lock cam turns to release the restraint of said lock lever, and said lock lever urged by said leaf spring turns to release its engagement with said receiving portion of said bottom plate.

PREFERRED EMBODIMENT OF THE INVENTION

Figure 1:
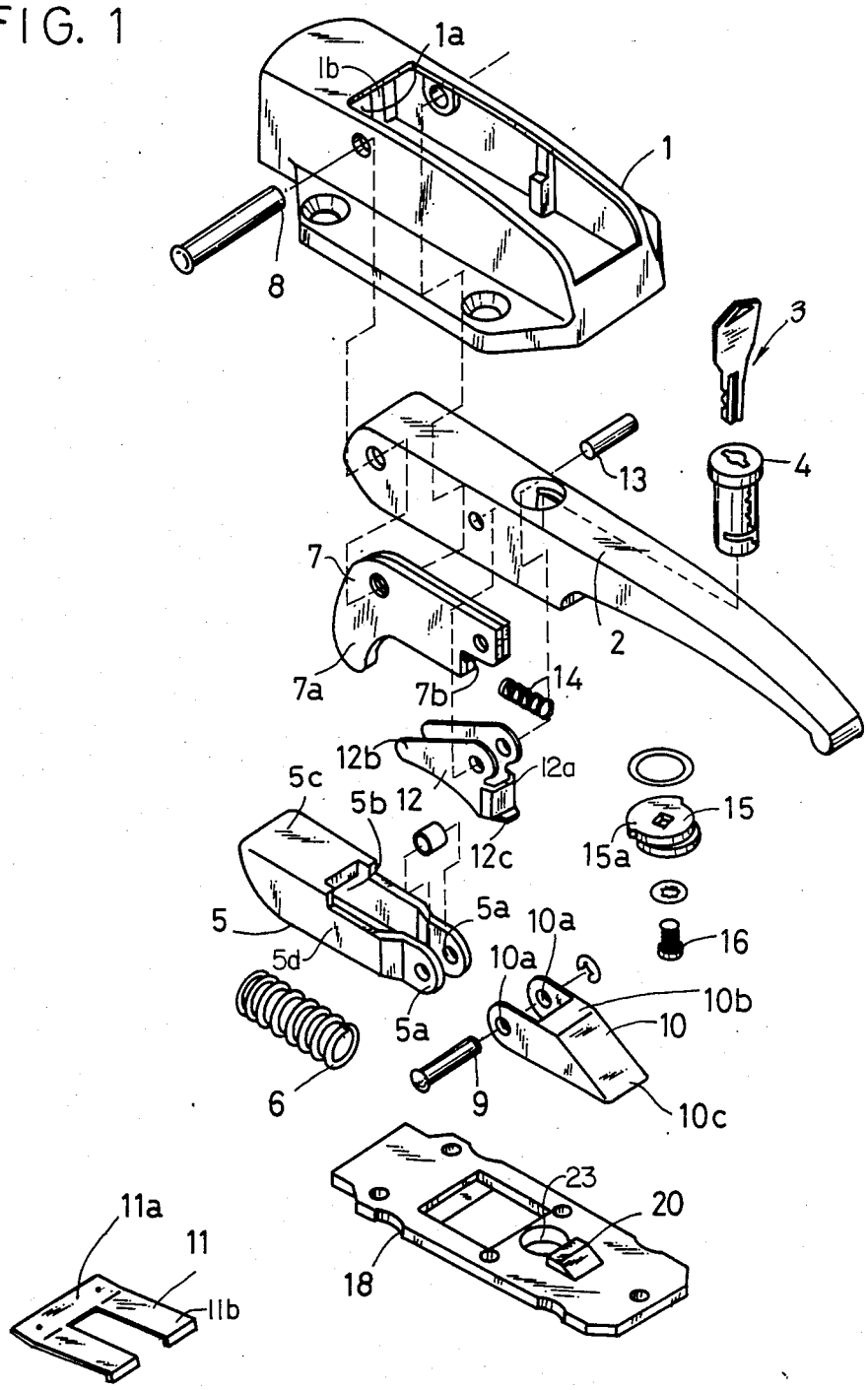
FIG. 1 is an exploded perspective view of a handle device for doors illustrative of an embodiment of the present invention.
Figure 2:
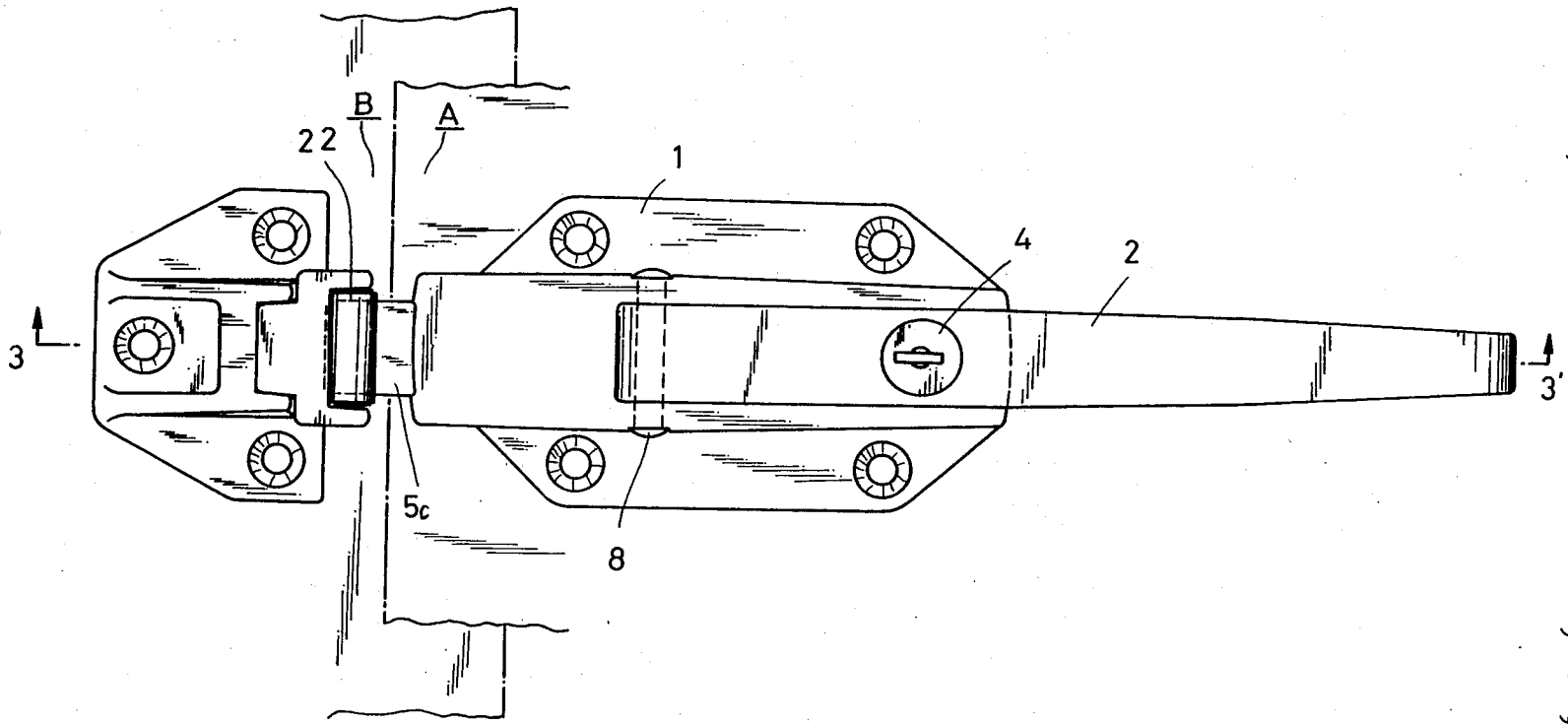
FIG. 2 is a front or top plan view of the handle device for doors.

The present invention will now be described with reference to the FIG. 1–6 drawings illustrating an embodiment thereof. The handle device for doors according to the present invention has a device body 1 which is installed on a front surface of a door panel A. A handle grip 2 is connected to the device body 1 by a first pivot pin 8. A latch 5 is retractably mounted in the device body 1, and has dual elongated side portions **5*d* which each extend through a slotted opening 1*b* in body wall 1*a* in body 1. An actuating lever 7 is connected in the device body 1 by the pivot pin 8, and is mounted unitarily with the handle grip 2 by a second pivot pin 13. A reset lever 12 is pivotally secured to the handle grip 2 by the pivot pin 13. A lock lever 10 is connected to the latch 5 by a third pivot pin 9, and checks the receding slide of the latch 5 by its rear end part 10*c* being in engagement with a receiving portion 20 provided in the bottom plate 18 of said device body 1**.

A reset spring 14 is retained in the handle grip 2, interposed between an inner wall **12*a* of the reset lever 12 and a vertical rear wall 7*b* of the actuating lever 7. The reset spring 14 also holds the reset lever 12 and a lock cam 15 in engagement, and also holds the front portion 12*b* of reset lever 12 and the lock lever 10 in engagement, as well as the engagement lock lever 10 rear end part 10*c* and receiving portion 20. A leaf spring 11 is retained in the device body 1 and is secured at its front base end 11*a* to the bottom plate 18, and releases the engagement between the lock lever 10 and the receiving portion 20**.

A lock 3 is mounted in the handle grip 2, and has the lock cam 15 in engagement with the reset lever 12 secured to a lock rotor 4 by a screw 16. When the rotor 4 of the lock 3 is turned, a protrusive piece **12*c* of the reset lever 12 is depressed and turned by the lock cam 15 about pin 13, so as to release the restraint of the lock lever 10. Thus, the lock lever 10 is urged by the rear end part 11*b* of leaf spring 11 and turns about pivot pin 9 so as to release its engagement with the receiving portion 20 of the bottom plate 18**.

In the illustrated embodiment, a front end part **7*a* of the actuating lever 7 is held in engagement with the pivot pin 9, which pin connects bearing holes at the rear end part 5*a* of the latch 5 and bearing holes at the front end part 10*a* of the lock lever 10. The latch 5 is urged to slide in an advancing direction by a coiled compression spring 6 which is interposed between an inner vertical wall 1***a* of the device body and an inner wall 5*b* of the latch 5 at the front end thereof, and a front end part 5*c* of latch 5 is held in engagement with a seat 22 secured to the body B of a refrigerator or the like.

Figure 3:
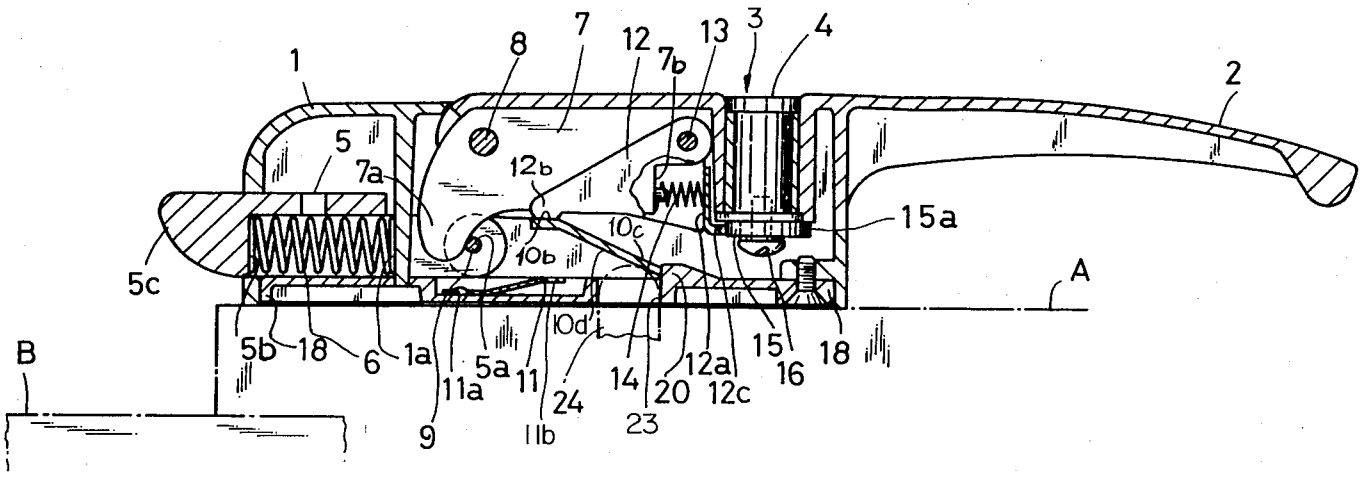
FIG. 3 is a sectional view taken along line 3—3' in FIG. 2.
Figure 4:
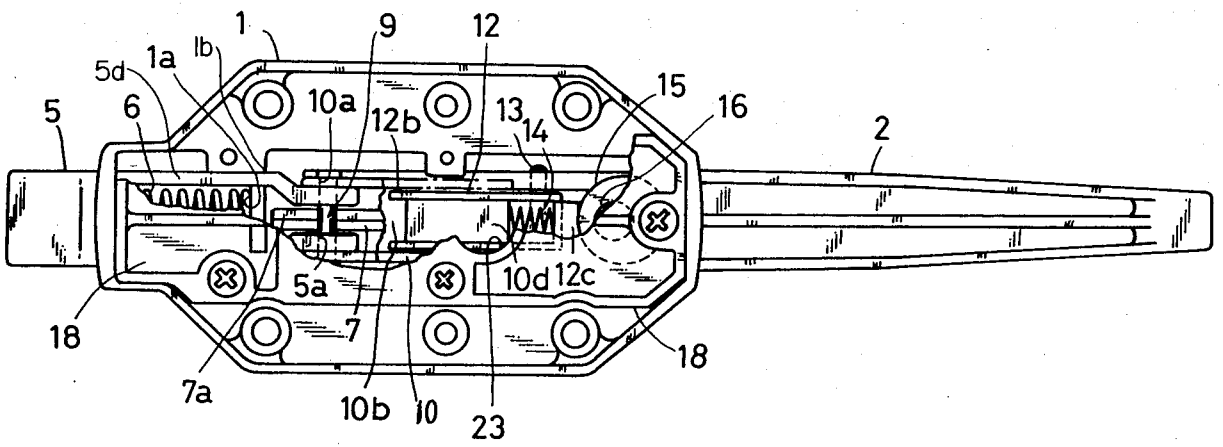
FIG. 4 is a bottom view of the handle device shown with a bottom plate partly broken away to further show the interrelationship of the parts.
Figure 5:
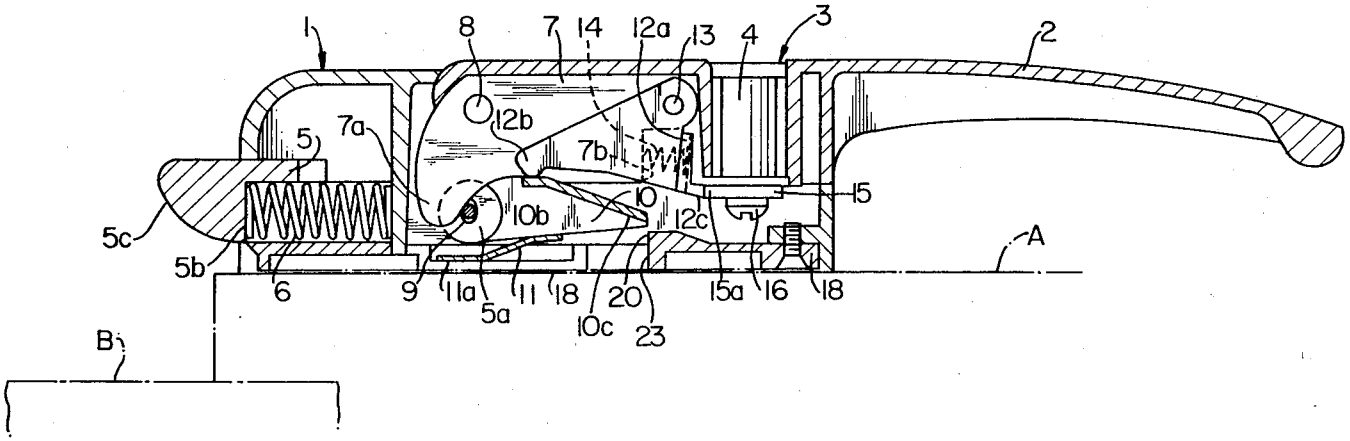
FIG. 5 is a sectional view of the handle device similar to FIG. 3 except that it shows the lock lever disengaged upwardly from the receiving portion of the bottom plate of the device body.
Figure 6:
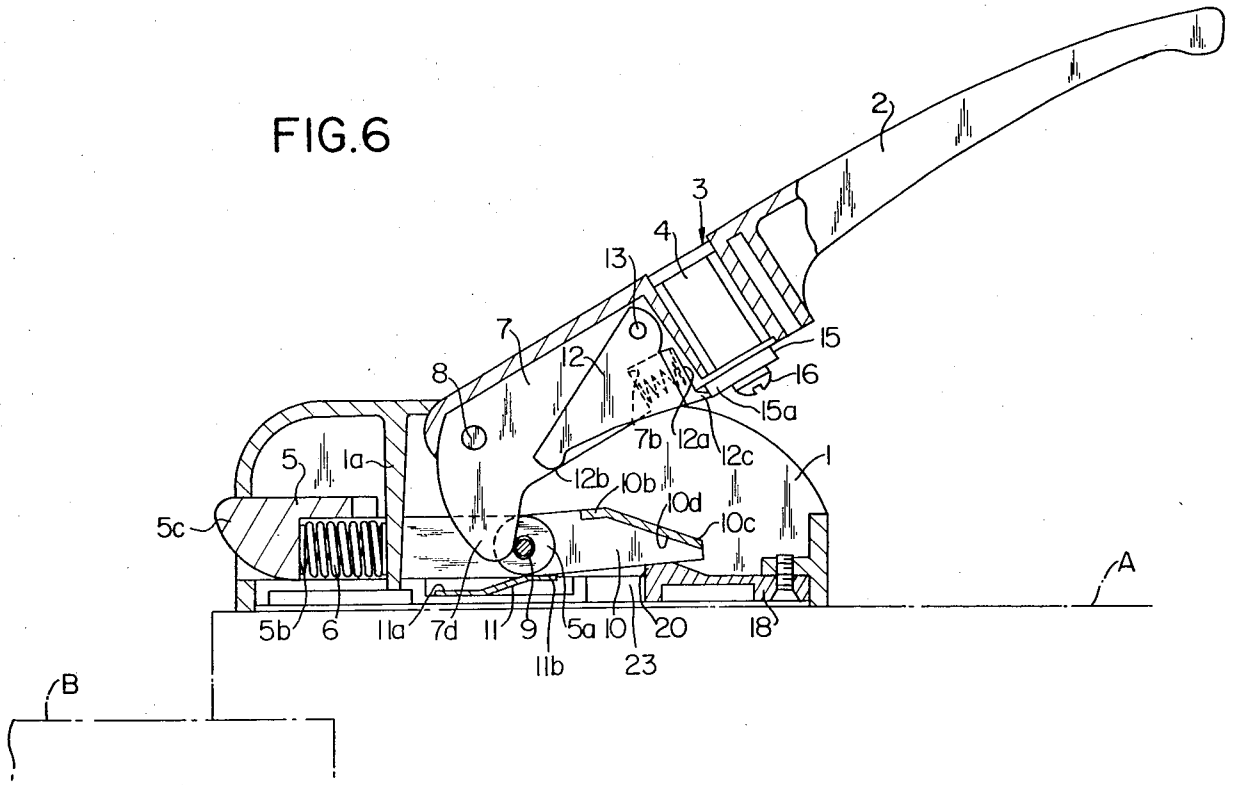
FIG. 6 is another sectional view of the handle device showing the handle grip rotated upwardly about a first pivot pin, so as to retract the latch rearwardly by an actuating lever attached to the handle grip.

As seen in FIG. 3, the reset lever 12 is urged to turn counterclockwise about pivot pin 13 by the coiled compression spring 14 interposed between the vertical wall 7*b* of the actuating lever 7 and the inner wall 12*a* of the reset lever 12, and its front end part 12*b* depresses the fore surface part 10*b* of the lock lever 10 while the door handle device is locked. The rear end part 10*c* of the lock lever 10 engages the receiving portion 20 protrusively provided in the bottom plate 18, thereby to check the receding slide of the latch 5 when actuated by the handle grip 2.

When the door A is to be unlocked, the rotor 4 of lock 3 is turned and the eccentric projection 15*a* of the rotated lock cam 15 depresses a protrusive piece 12*c* formed at the rear end of the reset lever 12, so that the reset lever 12 then turns clockwise about second pivot pin 13 as viewed in FIG. 3, and front end part 12*b* is lifted from the fore surface part 10*b* of the lock lever 10. When the restraint of the lock lever 10 is thus released, the leaf spring 11 for which base end part 11*a* is secured to the bottom plate 18 turns the lock lever 10 counterclockwise, so that the engagement between the lock lever 10 rear end lO*c* and the receiving portion 20 is released.

According to the present invention, the lock 3 and the lock cam 15 engage only with the reset lever 12 and lock 3 does not directly engage the latch 5, the handled grip 2 and lock lever 10. Therefore, when the handle grip 2 is unreasonably intended to be drawn and rotated when in the locked state, the handle force is received only by the bottom plate 18 of the device body 1 as a compressive stress. Therefore, the lock 3 does not suffer distortion damages, and a door handle device of long lifetime is provided.

Besides the foregoing embodiment of the invention, a push rod 24 may be passed from inside door A through a push rod hole 23 which is formed in the bottom plate 18, as generally shown by FIG. 3. When the push rod 24 is pushed from inside the door A, i.e., inside the refrigerator or the like, a front end part of the push rod 24 pushes against the inner wall 10*d* of the lock lever 10 to release engagement between the lock lever tne the receiving portion 20. When the push rod 24 is further pushed, the handle grip 2 can be turned. Therefore, the door can be opened even when in the locked state, and the danger of the confinement of an operator in the refrigerator is eliminated.

I claim:

1. A handle latch and lock mechanism for a door, comprising:

a body 1 which is installed on a door panel A;

a handle grip 2 which is connected to said body 1 by a first pivot pin 8;

a latch 5 which is retractably mounted on said body 1;

an acuating level 7 which is connected in said body 1 by said first pivot pin 8 and which is mounted unitarily with said handle grip 2 by a second pivot pin 13, a front end part 7*a* of the actuating lever 7 abutting on a third pivot pin 9 fixed on a rear end 5*a* of the latch 5 so as to retract said latch 5 owing to rotating of the handle grip 2 about said first pivot pin 8;

a compression spring 6 which is interposed between said body 1 and said latch 5 so as to urge the latch 5 to slide in an advancing direction;

a bottom plate 18 which is fixed to said body 1;

a lock 3 which is mounted on said handle grip 2 and which has a lock cam 15 secured to a rotor 4, said latch 5 becoming retractable after turning the lock cam 15;

a reset lever 12 which is pivotally connected to said handle grip 2 by said second pivot pin 13 and which has a protrusive piece 12*c* formed at a rear end thereof, said protrusive piece 12*c* abutting on an eccentric projection 15*a* of said lock cam 15;

a lock lever 10 which is connected to said rear end 5*a* of the latch 5 by said third pivot pin 9 and a rear end part 10*c* which is engageable with a receiving portion 20 protrusively provided on said bottom plate 18 so as to check the retracting of said latch 5;

a reset spring 14 which is interposed between an inner wall 12*a* of the reset lever 12 and a rear vertical wall 7*b* of said actuating lever 7 and which pushes said protrusive piece 12*c* of the reset lever 12 against said lock cam 15 to hold an engagement therebetween and also pushes a front end part 12*b* of said reset lever 12 on a fore surface part 10*b* of said lock lever 10 to hold an engagement between said rear end part 10*c* of the lock lever 10 and said receiving portion 20 of the bottom plate 18;

a leaf spring 11 which is secured at its front end 11*a* to said bottom plate 18 and which pushes up said lock lever 10 at its rear end 11*b* so as to release said engagement between said rear end part 10*c* of the lock lever 10 and said receiving portion 20 when said protrusive piece 12*c* of the reset lever 12 is pushed by an eccentric projection 15*a* of said lock cam 15 owing to a rotation of the lock cam 15 and thereby said reset lever 12 is rotated;

whereby said rear end part 10*c* of the lock lever 10 disengages from said receiving portion 20 of the bottom plate 18, and the reset lever 12 pushed by said lock lever 10 is rotated about said second pivot pin 13 and then the handle grip 2 is rotated about said first pivot pin 8, and thereby said latch 5 is retracted with said actuating lever 7 so as to render the door openable.

2. A handle latch and lock mechanism for a door according to claim 1, wherein said bottom plate is formed with a push rod hole 23 therein; a push rod extends inside the door through the push rod hole, so that when said push rod is pushed from inside the door, the engagement between said lock lever 10 and said receiving portion 20 is released to render the door openable.

3. A handle latch and lock mechanism for a door according to claim 1, wherein a front end part 5*c* of said latch 5 is held in engagement with a seat 22 which is secured to a stationary body.

4. A handle latch and lock mechanism for a door, comprising:

a body 1 which is installed on a door panel A;

a handle grip 2 which is connected to said body 1 by a first pivot pin 8;

a latch 15 which is retractably mounted on said body 1;

an actuating lever 7 which is connected in said body 1 by said first pivot pin 8 and which is mounted unitarily with said handle grip 2 by a second pivot pin 13, a front end part 7*a* of the actuating lever 7 abutting on a third pivot pin 9 fixed on a rear end 5*a* of the latch 5 so as to retract said latch 5 owing to rotating of the handle grip 2 about said first pivot pin 8;

a coiled compression spring 6 which is interposed between said body 1 and said latch 5 so as to urge the latch 5 to slide in an advancing direction;

a bottom plate 18 which is fixed to said body 1 and which has therein a push rod hole 23;

a push rod 24 which extends inside of the door through the push rod hole 23 and which when pushed from inside of the door retracts the latch 5 against the urging of said spring 6; and a lock 3 which is mounted on said handle grip 2 and which has a lock cam 15 secured to a rotor 4, said latch 5 becoming retractable after turning the lock cam 15;

a reset lever 12 which is pivotally connected to said handle grip 2 by said second pivot pin 13 and which has a protrusive piece 12*c* formed at a rear end thereof, said protrusive piece 12*c* abutting on an eccentric projection 15*a* of said lock cam 15;

a lock lever 10 which is connected to said rear end 5*a* of the latch 5 by said third pivot pin 8 and a rear end part 10*c* which is engageable with a receiving portion 20 protrusively provided on said bottom plate 18 so as to check the retracting of said latch 5;

a reset spring 14 which is interposed between an inner wall 12*a* of the reset lever 12 and a rear vertical wall 7*b* of said actuating lever 7 and which pushes said protrusive piece 12*c* of the reset lever 12 against said lock cam 15 to hold an engagement therebetween and also pushes a front end part 12*b* of said reset lever 12 on a fore surface part 10*b* of said lock lever 10 to hold an engagement between said rear end part 10*c* of the lock lever 10 and said receiving portion 20 of the bottom plate 18;

a leaf spring 11 which is secured at its front end 11*a* to said bottom plate 18 and which pushes up said lock lever 10 at its rear end 11*b* so as to release said engagement between said rear end part 10*c* of the lock lever 10 and said receiving portion 20 when said protrusive piece 12*c* of the reset lever 12 is pushed by an eccentric projection 15*a* of said lock cam 15 owing to a rotation of the lock cam 15 and thereby said reset lever 12 is rotated;

whereby said rear end part 10*c* of the lock lever 10 disengages from said receiving portion 20 of the bottom plate 18, and the reset lever 12 pushed by said lock lever 10 is rotated about said second pivot pin 13, and then the handle grip 2 is rotated about said first pivot pin 8, and thereby said latch 5 is retracted with said actuating lever 7 so as to render the door openable.

* * * * *